United States Patent [19]

Kelly

[11] 4,398,783

[45] Aug. 16, 1983

[54] COAXIAL CABLE CONNECTOR

[75] Inventor: Michael J. Kelly, Riverside, Calif.

[73] Assignees: International Telephone & Telegraph Corporation, New York, N.Y.

[21] Appl. No.: 275,889

[22] Filed: Jun. 22, 1981

[51] Int. Cl.[3] ..... H01R 17/18

[52] U.S. Cl. ..... 339/177 E; 339/212

[58] Field of Search ..... 339/14 P, 177 R, 177 E, 339/212

[56] References Cited

U.S. PATENT DOCUMENTS

| | | | |
|---|---|---|---|
| 2,958,845 | 11/1960 | Dupre et al. | 339/212 X |
| 3,221,290 | 11/1965 | Stark et al. | 339/177 R |
| 3,227,993 | 1/1966 | Bentley | 339/177 R |
| 3,243,760 | 3/1966 | Dupre et al. . | |
| 3,474,385 | 10/1969 | Cefarelli et al. . | |
| 3,548,365 | 12/1970 | Barker . | |
| 3,643,201 | 2/1972 | Harwood . | |
| 3,761,844 | 9/1973 | Reeder . | |
| 3,990,766 | 11/1976 | Volinskie et al. . | |
| 4,012,095 | 3/1977 | Doucet et al. . | |
| 4,060,887 | 12/1977 | De Groef . | |
| 4,231,629 | 11/1980 | Kirby . | |
| 4,326,769 | 4/1982 | Dorsey et al. | 339/177 E |

FOREIGN PATENT DOCUMENTS

| | | | |
|---|---|---|---|
| 2382112 | 10/1978 | France | 339/177 R |

*Primary Examiner*—Howard N. Goldberg

*Attorney, Agent, or Firm*—T. E. Kristofferson; T. L. Peterson; T. E. Kristofferson

[57] ABSTRACT

A connector is disclosed for coupling a coaxial cable to terminal pins on a printed circuit board to provide EMI/RFI shielding for a signal pin on the board. The insulator of the connector has a center contact cavity for receiving a socket contact which is connected to the center conductor of the coaxial cable. Longitudinal grooves in the outer surface of the insulator form outer contact cavities for ground terminal pins on the PC board. Integral resilient contact fingers formed on the shell extend inwardly into the outer cavities to engage the ground pins.

9 Claims, 6 Drawing Figures

10
12
22
22a
22b
23
18
24
26
28
30
32
34
36
38
40
42
44
46
47
48
52
54
58
60
62
66

COAXIAL CABLE CONNECTOR

BACKGROUND OF THE INVENTION

The present invention relates generally to an electrical connector and, more particularly, to an electrical connector for connecting a coaxial cable to a plurality of terminal pins on a printed circuit board.

Sometimes it is desirable to connect a coaxial cable to terminal pins such as wire wrappable posts on a printed circuit board in such a manner as to provide EMI/RFI shielding for a signal pin on the board. This is normally accomplished by soldering the center conductor of the coaxial cable to the signal pin and by soldering the outer conductor or braid of the cable to several ground pins spaced outwardly from the signal pin on the board. Such a connection is time consuming to perform and expensive. It is therefore desirable to provide an electrical connector which will provide a releasable connection between the coaxial cable conductors and the signal and ground pins on the board.

U.S. Pat. Nos. 3,643,201 and 3,761,844 disclose impedance matching connectors for coaxial cables in which a plurality of electrical contacts mounted on the connector of the cable are arranged to mate with corresponding contacts mounted on or in an insulator of a mating connector assembly. In each instance, the coaxial cable connector requires discrete ground contacts which add to the cost and the time for assembly of the connector.

It is therefore the object of the present invention to provide an improved coaxial cable connector for coupling to a plurality of terminal pins which utilizes a minimum number of parts and consequently is relatively inexpensive to manufacture and assemble.

SUMMARY OF THE INVENTION

According to a principal aspect of the present invention there is provided an electrical connector for connecting a coaxial cable to a plurality of terminal pins including a signal pin and a plurality of ground pins spaced outwardly from the signal pin in a predetermined pattern. The connector includes a hollow metal shell containing an insulator. The shell is adapted for connection to the outer conductor of the coaxial cable. A plurality of longitudinally extending grooves are formed in the outer surface of the insulator arranged in a pattern corresponding to the predetermined pattern of the ground pins whereby the grooves may receive the pins when the connector is mated with the set of pins. The wall of the shell is formed with contact elements each extending into one of the grooves for engaging one of the ground pins. A contact cavity is provided in the interior of the insulator which is located to receive the signal pin. A contact mounted in the cavity and connected to the inner conductor of the cable mates with the signal pin of the set of terminal pins.

Thus, by the present invention the contacts for the ground pins are integral with the shell of the connector which in turn is coupled to the outer conductor of the coaxial cable thereby avoiding the necessity of having separate contacts in the connector for making the connection between the outer conductor and the ground pins. Other aspects and advantages of the invention will become more apparent as the description proceeds.

DESCRIPTION OF THE PREFERRED EMBODIMENTS

Figures 1, 2, 3:
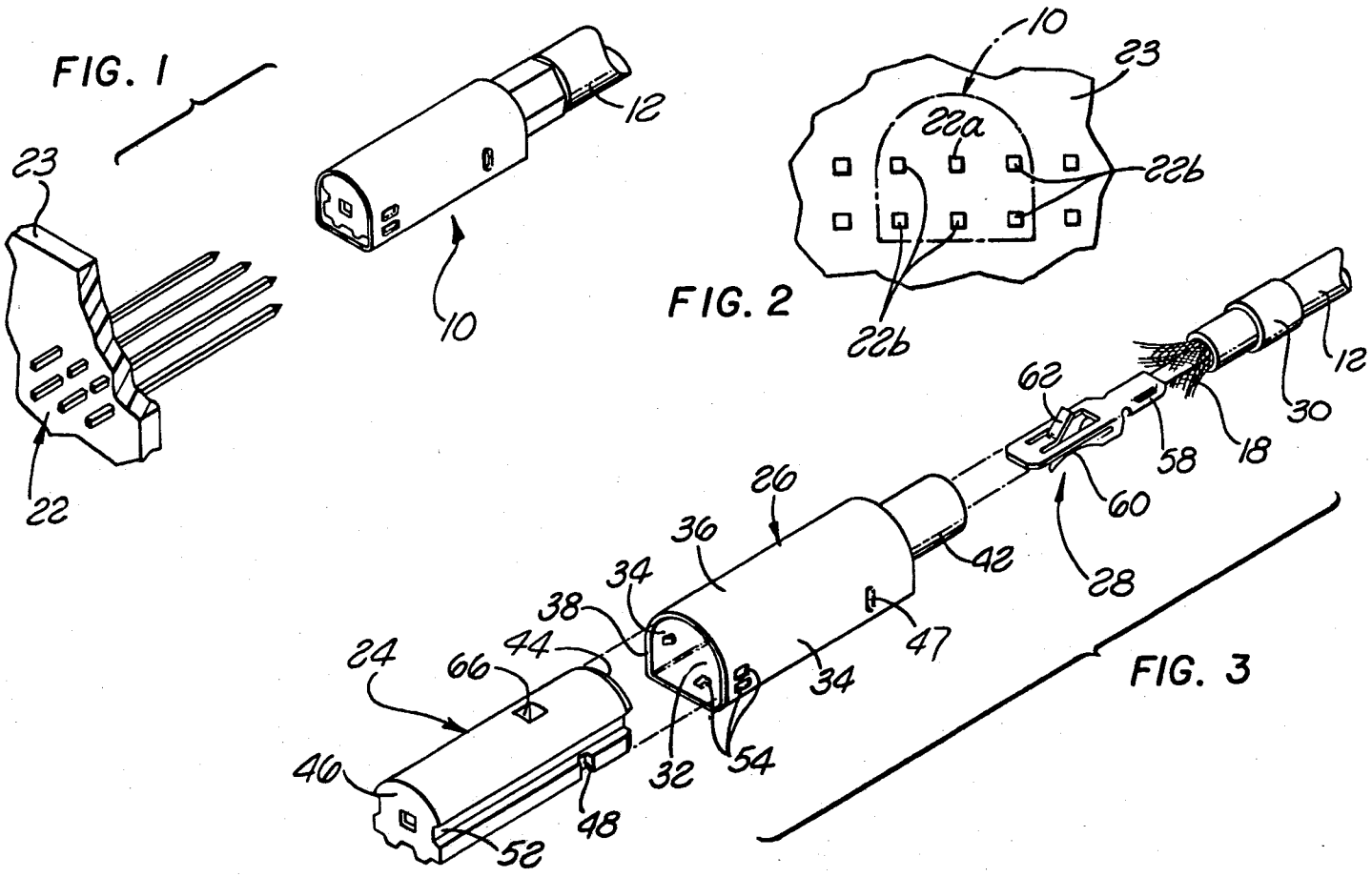
FIG. 1 is a perspective view showing the connector of the invention coupled to a coaxial cable just prior to being assembled with the terminal pins on a printed circuit board.
FIG. 2 is a fragmentary top plan view of the printed circuit board illustrated in FIG. 1 showing the connector of the invention in outline in the position it will assume when coupled to some of the pins on the board.
FIG. 3 is an exploded perspective view of the connector showing how the socket contact of the connector is coupled to the coaxial cable.
Figure 4:
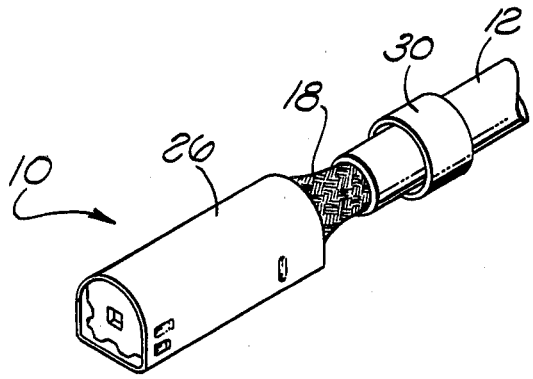
FIG. 4 is a perspective view of the connector assembled to the coaxial cable just prior to moving the crimp sleeve thereof into position for coupling the outer conductor of the cable to the shell of the connector housing.
Figure 5:
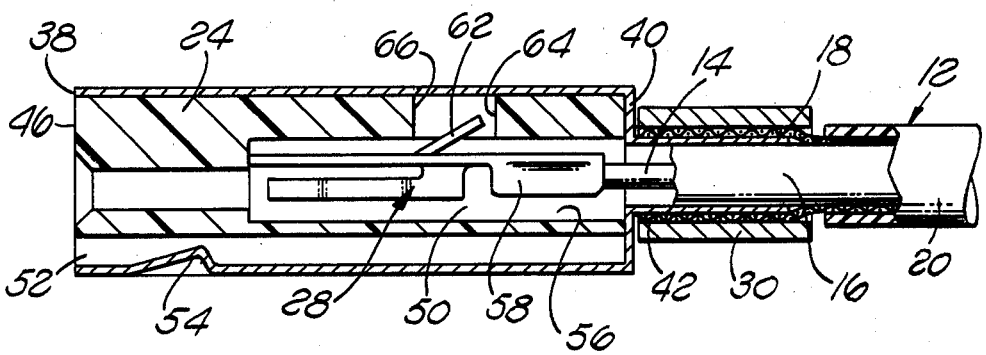
FIG. 5 is a partial longitudinal sectional view of the connector illustrated in FIG. 1 showing the crimp sleeve in its final position.

Referring now to FIGS. 1 to 5 of the drawings in detail, there is shown one embodiment of the connector of the present invention, generally designated 10. The connector is coupled to a coaxial cable 12 having an inner conductor 14 surrounded by an insulation sleeve 16 and a outer conductor or braid 18 covered by an outer insulation jacket 20. The connector 10 is adapted for connection to a set of six terminal pins 22 mounted on a printed circuit board 23. As illustrated in FIG. 2, two parallel rows of terminal pins are mounted on the board. The pins may be wire wrappable posts of square cross section which are press fit into plated-through holes in the prined circuit board. The pin **22*a* is a signal pin while the remaining five pins 22*b* adjacent to but spaced outwardly from the signal pin are ground pins. The purpose of the connector 10 is to provide electrical connection between the signal pin 22*a* and the inner conductor 14 of the coaxial cable, and an electrical connection between the ground pins 22*b* and the braid 18** of the cable.

The connector 10 consists of only four parts, namely an insulator 24, a hollow metal shell 26, a socket contact 28 and a crimp sleeve 30. The shell 26 has a flat bottom 32, a pair of flat parallel upstanding sides 34 and a semicylindrical top 36. The insulator 24 has a configuration similar to that of the shell and is dimensioned to slidably fit into the forward end 38 of the shell. The shell also embodies a radially inwardly extending flange 40 which is connected to a rear tubular extension 42. When the insulator 24 is inserted into the shell 26 from the front, the rear 44 of the insulator will abut against the flange 40. In such position, the front 46 of the insulator is essentially flush with the forward end 38 of the shell. Lateral slots 48 are formed on the sides of the insulator 24 which receive inwardly extending resilient dimples 47 formed on the opposite sides 34 of the shell for retaining the insulator in the shell.

The insulator 24 embodies a center longitudinally extending contact cavity 50 in the interior thereof and five longitudinally extending grooves 52 in its outer surface. The cavities and grooves each extend from the front 46 to the rear 44 of the insulator. The grooves 52 are arranged in a pattern corresponding to the pattern of the five ground pins 22*b* on the printed circuit board so that the grooves will receive such pins when the connector 10 is coupled to the set of pins 22. Dimples 54 are formed in the wall of the metal shell 26 to provide electrical contact elements for the ground pins 22*b*. Four of the dimples 54 are formed in the sides 34 of the shell while one of the dimples is formed in the bottom 32 thereof. Each dimple exrtends inwardly into one of the corresponding grooves 52 to provide electrical contact between the ground pins 22*b* and the shell 26 of the connector. The use of dimples as the contact elements has the advantage that no openings are formed in the wall of the shell around the dimples, as would occur with spring fingers stamped from the wall of the shell, so that EMI/RFI leakage will not occur through the shell wall. However, if such leakage is not a problem, stamped spring fingers could be used.

The contact cavity 50 in the insulator 24 has an enlarged rear section 56 which receives the socket contact 28. The socket contact embodies a crimp barrel 58 which is connected to the inner conductor of the coaxial cable. The contact also embodies a pair of resilient spring beams 60 which resiliently engage the signal pin 22*a* when the connector is coupled to the set of pins 22. An outwardly extending resilient retention finger 62 is formed on the contact which engages a forwardly facing shoulder 64 formed by a sqaure opening 66 in the upper portion of the insulator.

To assemble the connector 10, initially the insulator 24 is pushed into the forward end of the metal shell 26 whereupon it is retained in the shell by the inter-engagement between the dimples 47 and slots 48 on the insulator. The contact 28 is then connected to the bared inner conductor 14 of the cable and the contact is inserted through the rear extension 42 of the shell into the contact cavity 50 until the retention finger 62 on the contact snaps into the opening 66 in the insulator to retain the contact therein. As the contact 28 and cable are pushed forwardly into the connector assembly, the braid 18 of the cable is laid over the rear extension 42. Thereafter, the crimp sleeve 30 which was previously slid over the cable prior to connecting the socket contact 28 to the inner conductor, is pushed forwardly over the braid and the rear extension. Then the sleeve is crimped, preferably in the form of a hex crimp, to secure and electrically connect the braid of the coaxial cable to the shell of the conductor. When the connector thus terminated to the cable is assembled to the set of terminal pins 22 on the printed circuit board, the ground pins 22*b* will slide into the grooves 52 in the insulator making electrical engagement with the shell of the connector, and hence the braid or outer conductor of the cable, by the contact of the dimples 54 to the ground pins. At the same time, the signal pin 22*a* on the printed circuit board slides into the center contact cavity 50 to make electrical connection to the contact 28 and hence the inner conductor of the cable.

Figure 6:
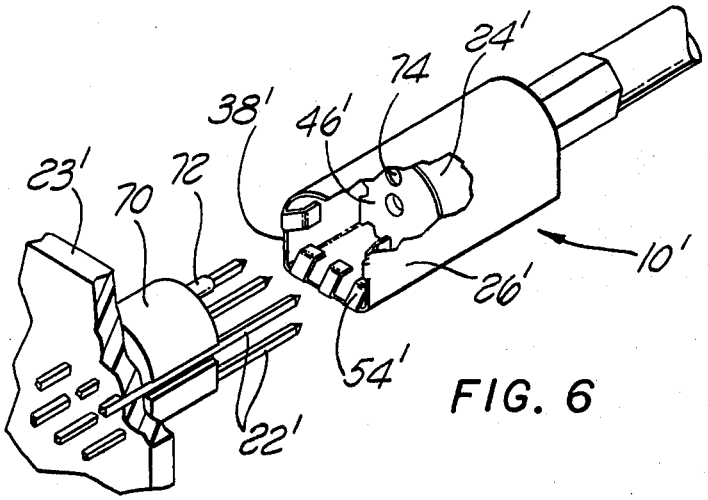
FIG. 6 is a perspective view similar to FIG. 1 illustrating an alternative form of the invention, with a portion of the connector housing removed to show the interior of the connector.

Reference is now made to FIG. 6 of the drawings which shows a modified form of the connector of the present invention, wherein like reference numerals primed are utilized to designate like or corresponding parts. In FIG. 6, resilient contact fingers 54' on the shell 26' provide the integral contact elements. The fingers are provided by forward extensions of the shell which are bent rearwardly as shown, rather than formed in the wall of the shell as in the first embodiment of the invention. In this case, the insulator 24' is shorter than the length of the shell so that the front 46' of the insulator is spaced rearwardly from the forward end 38' of the shell. Also, in this embodiment, a polarizing insert 70 is mounted over the termial pins 22'. The configuration of the insulator 70 corresponds to the interior of the shell 26', and has a length substantially equal to the distance between the forward end 38' of the shell and the front 46' of the insulator 24' so that when the connector is mated with the set of terminal pins 22' the polarizing insulator 70 will fit into the forward open region of the shell 26'. The polarizing insulator embodies an outwardly extending cylindrical pin 72 which fits into a corresponding axially extending bore 74 in the insulator 24'. By this arrangement, it is assured that the connector 10' will couple only with selected terminal pins 22' on the PC board 33' and in only one position with respect to such pins.

I claim:

1. An electrical connector for connecting a coaxial cable to a plurality of terminal pins including a signal pin and a plurality of ground pins spaced outwardly from said signal pin in a predetermined pattern, said coaxial cable including inner and outer conductors, comprising:

a hollow metal shell containing an insulator having a front and a rear, said shell being adapted to be connected to said outer conductor of said cable;

a plurality of longitudinally extending grooves in the surface of said insulator opening at said front and arranged in a pattern corresponding to said predetermined pattern whereby said grooves may receive said ground pins;

the wall of said shell having contact elements thereon facing one of said grooves for engaging a ground pin;

a contact cavity in the interior of said insulator extending from said front to said rear and positioned to receive said signal pin; and a contact mounted in said cavity adapted to be connected to said inner conductor of said cable.

2. An electrical connector as set forth in claim 1 wherein: said contact elements are dimples formed in the wall of said shell and extending into said grooves.

3. An electrical connector as set forth in claim 1 wherein:

said contact elements are resilient fingers formed from forward extensions of said shell which are bent rearwardly into said grooves.

4. An electrical connector as set forth in claim 1 wherein:

said insulator embodies a slot in its outer surface extending transversely to the longitudinal axis of said insulator; and a dimple on said shell extends into said slot to retain said insulator in said shell.

5. An electrical connector as set forth in claim 1 including:

a rear tubular extension on said shell aligned with said contact cavity; and a crimp sleeve surrounding said tubular extension for attaching said outer conductor of said cable to said extension.

6. An electrical connector as set forth in claim 1 including:

cooperating means on said contact and contact cavity for releasably retaining said contact in said cavity, said contact being removable from the rear of said cavity.

7. An electrical connector as set forth in claim 1 wherein:

the wall of said shell is devoid of any openings therethrough.

8. An electrical connector-coaxial cable assembly for connecting the coaxial cable to a plurality of terminal pins including a signal pin and a plurality of ground pins spaced outwardly from said signal pin in a predetermined pattern, comprising:

a coaxial cable including inner and outer conductors;

a hollow metal shell containing an insulator having a front and a rear, said shell being connected to said outer conductor of said cable;

a plurality of longitudinally extending grooves in the surface of said insulator opening at said front and arranged in a pattern corresponding to said predetermined pattern whereby said grooves may receive said ground pins;

the wall of said shell having integral contact elements formed thereon each extending into one of said grooves for engaging a ground pin;

a contact cavity in the interior of said insulator extending from said front to said rear and positioned to receive said signal pin; and a contact mounted in said cavity connected to said inner conductor of said cable.

9. An electrical connector assembly as set forth in claim 8 including:

a rear tubular extension on said shell aligned with said contact cavity;

said outer conductor of said cable extending over said extension; and a sleeve crimped around said outer conductor and extension attaching said outer conductor to said shell.

* * * * *